United States Patent [19]

Kimura et al.

[11] 4,367,719

[45] Jan. 11, 1983

[54] CROSS-FLOW TYPE INTERNAL COMBUSTION ENGINE HAVING AN EXHAUST GAS RECIRCULATION SYSTEM

[75] Inventors: Susumu Kimura, Tokyo; Hiroyosi Ario; Minoru Midorikawa, both of Koganei, all of Japan

[73] Assignee: Nissan Motor Co., Ltd., Yokohama, Japan

[21] Appl. No.: 239,658

[22] Filed: Mar. 2, 1981

[30] Foreign Application Priority Data

Mar. 3, 1980 [JP] Japan ..... 55-26154[U]

[51] Int. Cl.[3] ..... F02M 25/06

[52] U.S. Cl. ..... 123/568; 123/52 MV

[58] Field of Search ..... 123/568, 52 MV, 668, 123/52 M

[56] References Cited

U.S. PATENT DOCUMENTS

| | | | |
|---|---|---|---|
| 4,072,133 | 2/1978 | McWhiater | 123/568 X |
| 4,147,031 | 4/1979 | Tanumura et al. | 60/278 |
| 4,201,165 | 5/1980 | Tanaka et al. | 123/568 |
| 4,221,203 | 9/1980 | Hayashi et al. | 123/568 |

FOREIGN PATENT DOCUMENTS

| | | | |
|---|---|---|---|
| 2318481 | 10/1973 | Fed. Rep. of Germany | 123/568 |
| 2412718 | 12/1978 | France . | |
| 52-59205 | 5/1977 | Japan | 123/568 |
| 54-113721 | 9/1979 | Japan | 123/568 |
| 54-150512 | 11/1979 | Japan | 123/568 |
| 1152957 | 5/1969 | United Kingdom | 123/668 |

*Primary Examiner*—Wendell E. Burns

*Attorney, Agent, or Firm*—Lowe, King, Price & Becker

[57] ABSTRACT

A cross-flow type internal combustion engine has an improved exhaust gas recirculation passage which comprises a first passage section formed in the intake manifold, a second passage section formed in the cylinder head and a third passage section formed in the exhaust manifold.

12 Claims, 6 Drawing Figures

CROSS-FLOW TYPE INTERNAL COMBUSTION ENGINE HAVING AN EXHAUST GAS RECIRCULATION SYSTEM

BACKGROUND OF THE INVENTION

1. Field of the Invention

The present invention relates in general to an internal combustion engine for a motor vehicle, and in particular to a cross-flow type internal combustion engine having an exhaust gas recirculation system capable of feeding a portion of the exhaust gases of the engine into the intake of the engine.

2. Description of the Prior Art

In order to suppress the formation of nitrogen oxides, ($NO_x$) in the exhaust gases from the internal combustion engine, a so-called "exhaust gas recirculation (or EGR) system" is widely used in which a portion of the exhaust gases is fed, during engine operation, into the engine via an intake manifold. With this procedure, the combustion temperature in each combustion chamber is considerably lowered to inhibit production of nitrogen oxides ($NO_x$). Usually, the EGR system hitherto employed comprises a separate metal tube which connects the interior of the exhaust manifold with that of the intake manifold and a flow controller disposed at a suitable portion of the tube. In fitting such EGR systems to a cross-flow type internal combustion engine, however, the conduit must be so arranged to extend over the engine thereby requiring a long tube. Employing such separate long tubes as part of the EGR system promotes condensation of exhaust gas components in the tube, because of the considerable cooling effect possessed by the tube, thereby rusting the tube. Further, employment of long conduit tubes causes bulky construction of the engine system, inevitably reducing the space available in the engine compartment of the motor vehicle and causing poor responsiveness in controlling the flow rate of recirculated gas with the flow controller.

SUMMARY OF THE INVENTION

It is therefore an object of the present invention to provide a cross-flow type internal combustion engine having an EGR system which is free of the above-mentioned drawbacks.

According to the present invention, there is provided an internal combustion engine having a cross-flow type cylinder head, an intake manifold mounted to one side of the cylinder head, a carburetor mounted upstream of the intake manifold, an exhaust manifold mounted to the other side of the cylinder head, and an exhaust gas recirculation system which feeds a portion of the exhaust gases of the engine into the intake manifold. The exhaust gas recirculation system comprises first means defining a first through passage formed in a block integral with the intake manifold, one end of the first through passage being open to a distribution chamber from which branch tubes of the intake manifold extend toward the cylinder head; second means defining a second passage formed in the cylinder head, one end of the second through passage being connected to the other end of the first through passage; third means defining a third through passage formed in a block integral with the exhaust manifold, one end of the third through passage being connected to the other end of the second through passage and the other end of the same being open to a portion downstream of branch tubes of the exhaust manifold; and gas flow rate control means for controlling the flow rate of the exhaust gas flowing in the connected first, second and third through passages in accordance with operation modes of the engine.

BRIEF DESCRIPTION OF THE DRAWINGS

Other objects and advantages of the present invention will become clear from the following description when taken in conjunction with the accompanying drawings, in which.

DESCRIPTION OF THE PRESENT INVENTION

Figure 1:
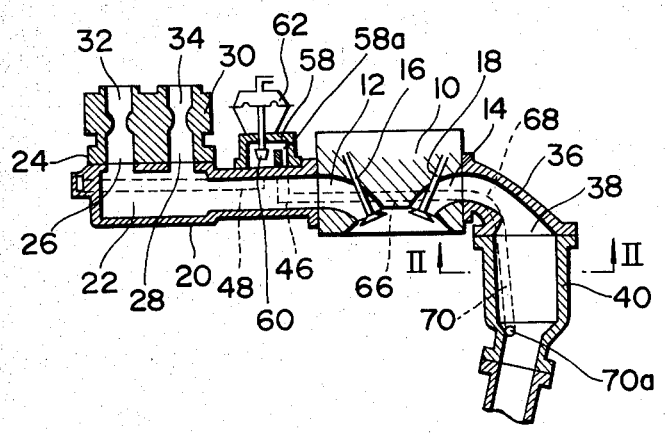
FIG. 1 is a sectional view of an internal combustion engine having an improved EGR system according to the present invention.

Referring to the drawings, especially FIG. 1, there is partially shown a cross-flow type internal combustion engine having an improved EGR system installed therein. The engine comprises a cylinder head 10 mounted on a cylinder block (not shown). The cylinder head 10 has a plurality of intake ports 12 and a plurality of exhaust ports 14, respectively connected to the corresponding cylinders formed in the cylinder block. Designated by numerals 16 and 18 are intake and exhaust valves which are operatively arranged in the corresponding ports, as shown.

An intake manifold 20 is bolted to the cylinder head 10 in such a manner that the branch tubes thereof are respectively connected through flanges (see FIG. 3) to the intake ports 12 of cylinder heat 10. The branch tubes are united at their upstream portions to form a distribution chamber 22. The chamber 22 has an upper wall 24 having separated primary and secondary holes 26 and 28 formed therethrough. A two-barrel carburetor 30 is mounted to wall 24 in such a manner that primary and secondary barrels 32 and 34 thereof are respectively connected to the primary and secondary holes 26 and 28 of wall 24; during engine operation, an air-fuel mixture is fed into distribution chamber 22 from carburetor 30. Now, it should be noted that in the primary barrel 32 of the carburetor 30, there always occurs an intake flow so long as the engine is under operation.

An exhaust manifold 36 is bolted to cylinder head 10 so that branch tubes thereof are respectively connected to exhaust ports 14 of cylinder head 10. The branch tubes are united at their downstream portions to form a confluent chamber 38. A catalytic converter 40 including a case 42 and a honeycomb type catalyzer holder 44 is connected to confluent chamber 38 for chemically treating the exhaust gases from the engine into harmless ones.

The exhaust gas recirculation (or EGR) system has a characteristic construction, which generally comprises first, second, third and fourth conduit sections which are connected in series and associated with the intake manifold 20, the cylinder head 10, the exhaust manifold 36 and the catalytic converter 40, respectively.

Figure 3:
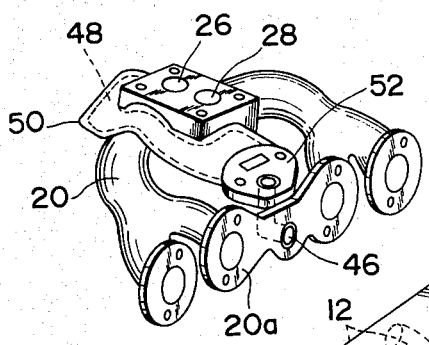
FIG. 3 is a perspective view of an intake manifold employed in the present invention.
Figure 5:
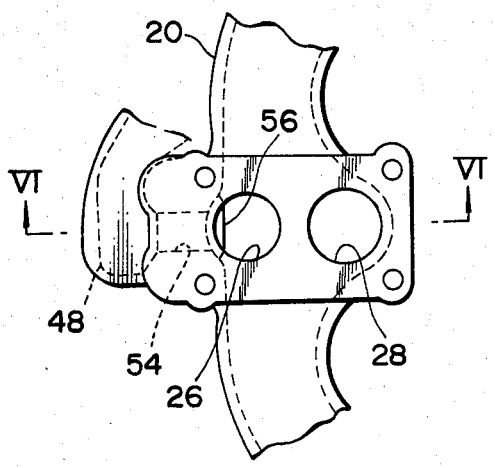
FIG. 5 is a top plan view showing a portion of the intake manifold.
Figure 6:
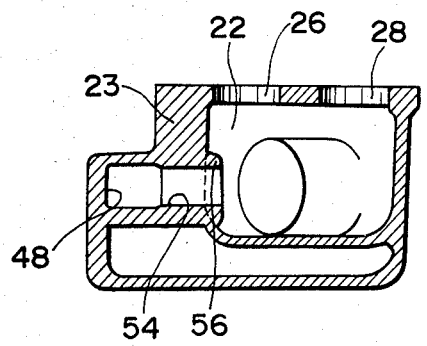
FIG. 6 is a sectional view taken along the line VI—VI of FIG. 5.

As will be seen from FIG. 3, the first conduit section comprises first and second passages 46 and 48 which are defined in a tubular structure 50 integrally mounted on intake manifold 20. Tubular structure 50 and intake manifold 20 are of a monoblock construction of casting. Tubular structure 50 is formed with a flat portion 52 where the first and second passages 46 and 48 are exposed. First passage 46 extends to an opening (no numeral) formed in a common flange 20*a* which the inside positioned branch tubes of the intake manifold 20 commonly have. As will be understood from FIGS. 5 and 6, second passage 48 extends to distribution chamber 22 through a port 54 which is formed in a side wall 23 located in the vicinity of the primary hole 26 connected to the primary barrel 32 of the carburetor 30. As is seen from FIG. 6, the extreme end of the port 54 is defined as an inwardly projected portion 56 formed on side wall 23. If desired, separate insulating liners (not shown) may be installed in first and second passages 46 and 48 for reducing heat loss of recirculating exhaust gases passing therethrough. In adopting this measure, the liners are made of a heat insulating and corrosion resistant material, such as stainless steel, and the liners are cast in the casting of the intake manifold 20. In using an aluminium alloy as the material of intake manifold 20, adoption of such liners is preferable. As is seen from FIG. 1, onto the flat portion 52 is sealingly mounted a valve casing 58 having a passage 58*a* connecting first and second passages 46 and 48. Movably disposed within passage 58*a* is a valve head 60 which is connected to a vacuum motor 62, more particularly, to a diaphragm member (no numeral) of vacuum motor 62. The vacuum chamber (no numeral) of vacuum motor 62 is connected, for example, to a venturi position of the carburetor 30 via a pipe (not shown).

Figure 4:
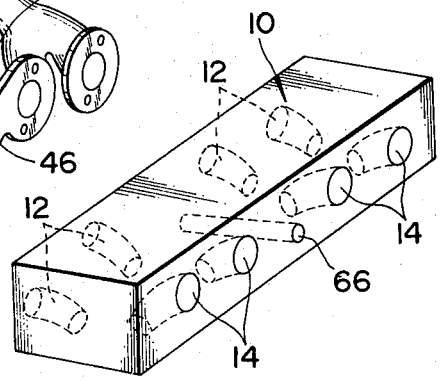
FIG. 4 is a perspective view of a cylinder head employed in the present invention.

The second conduit section of the EGR system is a through passage 66 formed in cylinder head 10. As will be seen from FIG. 4, passage 66 extends from the intake manifold side to the exhaust manifold side.

The third conduit section of the EGR system is a passage 68 which is defined in a tubular structure integrally mounted on the exhaust manifold 36. Similar to case of passages 46 and 48 of intake manifold 20, the tubular structure and the exhaust manifold 36 are of a monoblock construction of casting.

Figure 2:
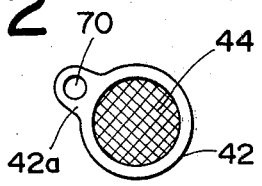
FIG. 2 is a sectional view taken along the line II—II of FIG. 1.

The fourth conduit section of the EGR system is a passage 70 formed in a raised portion 42*a* of catalytic converter case 42, as is seen from FIG. 2. Passage 70 has an exhaust gas intake opening 70*a* open to the interior of case 40 downstream of catalyzer holder 44. (Now, it should be noted that when the catalytic converter 40 is not provided, the exhaust gas intake opening may be open to the confluent chamber 38 of the exhaust manifold 36.)

During engine operation, a portion of the exhaust gases is sucked into the exhaust gas intake opening 70*a* and compelled to flow through the passages 70, 68, 66, 46, 58*a* and 48 into distribution chamber 22 of intake manifold 20, due to a pressure differential between the exhaust conduit system and the intake conduit system of the engine. With the provision of the gas flow controller including valve casing 58 and vacuum actuated valve 60, the amount of recirculating exhaust gas is suitably controlled in accordance with the operation modes of the engine to effectively reduce creation of $NO_x$ in the exhaust gases from the engine.

With the above-mentioned construction of the engine system according to the present invention, the following merits and advantages are obtained:

(1) Since the major means of the EGR system are formed in the built-in parts of the engine, the entire construction of the engine is compact, thereby requiring only small mounting space in an engine compartment of the vehicle.

(2) Since the recirculating gas is compelled to pass through the passages such as 70, 68 and 66 which are considerably heated under operation of the engine, the undesired recirculating exhaust gas condensation does not occur.

(3) Since the conduit construction of the EGR system of the invention is made shorter in length than that of using a separate pipe as in the conventional one, the responsiveness in controlling the flow rate by the gas flow controller is improved.

(4) Since the outlet opening, that is the port 54 in the side wall 23 (see FIG. 6), of the EGR system is open to the vicinity of the primary barrel 32 of the carburetor 30, the mixing of the recirculated gas from the EGR conduit with the air-fuel mixture from the carburetor 30 is effectively made. This is because there always occurs an intake flow in the primary barrel 32 so long as the engine is under operation.

(5) Since any pipes and any pipe supporting brackets are not necessitated in the invention, the production of the engine system is economical.

What is claimed is:

1. An internal combustion engine having a cross-flow type cylinder head, an intake manifold mounted to one side of said cylinder head, a carburetor arranged upstream of said intake manifold, an exhaust manifold mounted to the other side of said cylinder head, and an exhaust gas recirculation system which feeds a part of the exhaust gas of said engine into said intake manifold, said exhaust gas recirculating system comprising:

a first block integrally mounted on said intake manifold, said first block including therein a first through passage having one end open to a distribution chamber of the intake manifold from which chamber branch tubes of the intake manifold extend toward said cylinder head and an opposite end connected to a second through passage formed in a portion of said cylinder head;

a second block integrally formed with said exhaust manifold, said second block including therein a third through passage having one end connected to the other end of said second through passage and an opposite end of third through passage being open to a portion downstream of branch tubes of the exhaust manifold; and gas flow rate control means for controlling the exhaust gas flowing in the connected first, second and third through passages in accordance with operation modes of said engines.

2. An internal combustion engine as claimed in claim 1, wherein said one end of the first through passage is defined as an inwardly projected portion formed on a side wall of said distribution chamber and projecting inwardly from the side wall.

3. An internal combustion engine as claimed in claim 2, wherein said one end of the first through passage is positioned closer to the primary barrel of said carburetor than the secondary barrel of the same.

4. An internal combustion engine as claimed in claim 3, wherein said first block is formed with a substantially flat portion on which said gas flow control means is mounted.

5. An internal combustion engine as claimed in claim 4, wherein said substantially flat portion is formed with two openings by which said first through passage is divided into two sections.

6. An internal combustion engine as claimed in claim 1, wherein said exhaust gas recirculation system further includes a corrosion resistant port liner disposed in said first through passage of sufficient thickness to prevent corrosion within the first passage.

7. The internal combustion engine of claim 1, wherein said first block and intake manifold are of a monoblock casting construction.

8. The internal combustion engine of claim 1 or 7, wherein said second block and exhaust manifold are of a monoblock casting construction.

9. The internal combustion engine of claim 1, wherein said first and third through passages respectively formed within the first and second blocks are dimensioned to provide a shorter exhaust gas recirculation flow path relative to exhaust gas recirculation systems having separate pipes forming a corresponding flow path.

10. The internal combustion engine of claim 1, wherein said first and second blocks are respectively formed as substantially tubular structures having major lengths of each in direct physical contact respectively with the intake manifold and the exhaust manifold.

11. The internal combustion engine of claim 3, wherein said inwardly projected portion projects into the flow path of the primary barrel, thereby mixing recirculated exhaust gas with the air/fuel mixture discharged from the primary barrel of the carburetor.

12. An internal combustion engine having a cross-flow type cylinder head, an intake manifold and exhaust manifold each being connected to opposite sides of the cylinder head, and an exhaust gas recirculation system, said exhaust system comprising:

first and second means defining a plurality of exhaust gas recirculation passageways connected to each other and through a passage formed in the cylinder head to provide an exhaust gas flow path for recirculating exhaust gas from the exhaust manifold to the intake manifold, said first and second means containing said passageways and being respectively of unitary construction with said intake manifold and exhaust manifold so that heat generated during engine combustion is transmitted substantially only through material forming the means to the passageways, to directly heat exhaust gas within the flow path prior to substantial heat loss to surrounding air; and gas flow rate control means for controlling the exhaust gas flow rate through the path responsive to engine operation modes.

* * * * *